United States Patent [19]

Kramer et al.

[11] Patent Number: 4,925,171

[45] Date of Patent: May 15, 1990

[54] SORTER/STAPLER WITH HORIZONTAL BIN OPENING

[75] Inventors: William E. Kramer, Fairport; Terrence D. Charland, Pittsford; John E. Forward, Penfield; William R. Burger; Barry P. Mandel, both of Fairport, all of N.Y.

[73] Assignee: Xerox Corporation, Stamford, Conn.

[21] Appl. No.: 241,999

[22] Filed: Sep. 8, 1988

[51] Int. Cl.[5] ..... B65H 39/11

[52] U.S. Cl. ..... 270/53; 270/52; 271/293

[58] Field of Search ..... 270/37, 52, 53, 58; 271/292, 293, 294

[56] References Cited

U.S. PATENT DOCUMENTS

| | | | |
|---|---|---|---|
| 3,995,748 | 7/1975 | Looney | 214/6 D |
| 4,083,550 | 4/1978 | Pal | 270/53 |
| 4,228,995 | 10/1980 | Breuers et al. | 271/292 |
| 4,313,670 | 9/1979 | Caldwell | 355/3 R |
| 4,337,936 | 7/1982 | Lawrence | 271/293 |
| 4,361,393 | 4/1981 | Noto | 355/3 SH |
| 4,681,310 | 9/1985 | Cooper | 270/53 |
| 4,687,191 | 4/1986 | Stemmle | 270/53 |
| 4,762,312 | 8/1988 | Ushirogata | 270/53 |
| 4,778,171 | 10/1988 | Hidaka | 271/293 |

FOREIGN PATENT DOCUMENTS

| | | | |
|---|---|---|---|
| 1125696 | 6/1982 | Canada . | |
| 50-137469 | 5/1977 | Japan | 271/294 |
| 55-0048154 | 4/1980 | Japan | 271/292 |
| 59-172385 | 9/1984 | Japan | 271/293 |

OTHER PUBLICATIONS

Xerox Disclosure Journal, vol. 8, No. 4, Jul./Aug., 1983, pp. 309–311, Melvin G. Crandell, Original Re-Staple.

*Primary Examiner*—Robert E. Garrett
*Assistant Examiner*—Therese M. Newholm

[57] ABSTRACT

In a sorter for sorting sheets fed from a sequential source of sheets, with a closely vertically spaced array of sorter bins, and apparatus to vertically move the array of sorter bins relative to the source of sheets for sequentially loading individual sheets into individual sorter bins, the improvement including partially horizontally displacing one individual sorter bin at a time from the superposed array, in coordination with the vertical movement, towards the source of sheets to provide an enlarged bin entry opening without requiring any change in the vertical spacing between the bins, and subsequently horizontally moving a bin so displaced back into vertically superposed alignment with the other bins of the array. Also disclosed is stapling sheets sorted into the bins, wherein the same system for partially horizontally displacing the sorter bins also functions to move one displaced bin at a time into the stapler for stapling the sheets sorted in that bin without removal therefrom. The system for partially horizontally displacing the sorter bins may utilize individual pins connecting with respective individual sorter bins in a substantially vertically aligned array and an open jaw actuating system through which the array of pins is movable, which open jaw is adapted to engage and horizontally move a selected pin therein. An alternative cam track system with a horizontal displacement transition therein is also disclosed for this function.

10 Claims, 3 Drawing Sheets

SORTER/STAPLER WITH HORIZONTAL BIN OPENING

This invention relates generally to sorters for collating sheets of paper or the like, such as the output of a copier, into sets, which may also have staples inserted therein, and more particularly to an improved and simplified system of sorter bin loading in which the bins are opened relative to one another for loading by a horizontal displacement relative to other bins while remaining consistently closely vertically spaced, to provide a low cost and simple but reliable sorting system.

There is disclosed herein an improved sorting (collating) system, which is compatible with copiers, for sorting the output copy sheets thereof, in which closely vertically stacked sorter bins or trays act as drawers which individually partially slide out horizontally at the desired loading location for improved sheet loading therein without requiring the normal unevenly increased vertical spacing between bins at the sheet loading zone, and which compatibly also provides stapling of sorted sets of sheets utilizing shared apparatus and operations for compactness and lower cost. Stapling may be accomplished with the same bins and bin movements as are used for loading and stacking or compiling the sorted sets of sheets. A simplified vertical movement system for the entire rack or array of bins may be provided since uneven vertical movement for uneven vertical spacing is not required with this sorter system. The generally horizontal drawer type bin movement combined with downwardly angled sheet loading thereinto provides reliable sheet access and loading into a bin.

The overall dual-mode sorter/stapler unit disclosed herein may be quite small, and is also designed to overcome sheet curl difficulties and to reduce productivity losses during stop or start. The disclosed configuration can provide compact yet reliable sheet sorting and stapling, as will be further explained herein.

The disclosed apparatus can alternatively be used as a standalone or off-line unit, as well as a connecting accessory to a copier. It can even additionally provide for automatic stapling of manually inserted sets at a convenient top stapling alternative stapler location using the same apparatus. It does not need to eject and stack the stapled sets, and can leave them in the same sorter bins after stapling. If desired, means to eject and stack all the stapled sets may be added, e.g. by a known ejector or moving jaw clamp, as cited herein.

A sorter with pivital bins with a lip on each bin engaging the sheet to be loaded into the bin by the bin individually pivoting out into a sorter paper path going past all the bins is shown in Xerox Corp. Canadian Patent No. 1,125,696 issued June 15, 1982 to Stanly G. Clarkson. It is also issued in Great Britain as U.K. Patent No. 1,522,068 issued December 6, 1978.

Of particular interest is Oce'-van der Grinten U.S. Pat. No. 4,228,995 issued Oct. 21, 1980 to T. Breuers et al, in which each bin of two vertically superposed arrays of horizontal bins can be individually horizontally displaced or swung (by a small distance) so that the integral sheet guide organ (scraping blade) of the displaced bin protrudes into a sheet transport track passing closely vertically by the fronts of all the bins. Noted particularly is the embodyment of FIG. 11 and Col. 7 lines 55 et al. Portions of the horizontal bin movement mounting and movement apparatus show there could perhaps be utilized as an alternative to that shown herein if substantially modified to provide a very much greater horizontal bin movement, in which a substantial portion of the selected bin itself is moved out from under and away from the other bins (not just a slight movement of sheet guide organ or scraping blade as shown here). Furthermore, in the present system, in contrast, a key feature is to open the tray out to, and provide a bin entrance path closely under, a fixed output of a copier, by coordinated vertical movement of the bins, to merge the two paper paths into an integral no-jam entrance chute from the copier into that bin. Note that that such a movement would not be possible in this Breuers et al apparatus itself because such a movement would be obstructed by the Breuers et al sheet transport track and vacuum plate which is passing closely vertically by the fronts of all the bins.

This is not the first disclosure of loading vertically arrayed sorter bins or sorter in-bin stapling, and not the first system to accomplish a sorting and set stapling operation without requiring a recirculating document handler precollation copier. i.e., providing on-line post-collation stapling by stapling sorted copy sets after they are sorted in the trays or bins of a copier. Of particular interest, U.S. Pat. No. 4,083,550 issued Apr. 11, 1978 to R. Pal shows moving out individual copier sorter trays for stapling, and then returning the emptied tray back to the rack, in an vertically movable array of sorter bins. U.S. Pat. No. 4,762,312 issued Aug. 9, 1988 to Y. Ushirogatn (Ricoh) discloses moving a loaded bin of a sorter towards a stapler for stapling. Other in-bin stapling systems with vertical sorter bin arrays are shown in U.S. Pat. Nos. 4,687,191 to Stemmle, 4,681,310 to Cooper, 3,995,748 to Looney, and Japanese laid open application Nos. 58-220053 laid open 21.12.83 to Nanba and 59-69346 laid open 9.10.82 to Nanba (Fuji Xerox K.K.), and others cited below. Edge jogging and glue binding sets in a sorter or collator is disclosed in Snellman et al U.S. Pat. No. 4,145,241. Hamlin et al U.S. Pat. No. 4,564,185 shows an on line rotary sorter copier unit with in-bin glue binding and/or stapling of the post-collated copy sets. U.S. Pat. No. 3,944,207 to Bains shows in-bin stapling with a horizontal sorter bin array. Withdrawal of the sets from the bins with a gripper extractor and stapling is shown for example in U.S. Pat. No. 4,361,393 to Noto.

It is well known in the art that a moving bin sorter has the advantage of moving the bins to be loaded past the output of the copier, so that a normal single position copy sheet output location can be used to load into a multi-bin sorter. As shown by the above and other art, typical moving bin sorters require vertically moving bins in which means must be provided for uneven vertical movement of the bins to provide a larger spacing between the bins at the point in which a sheet is being loaded into a bin. Otherwise paper feeding or stacking jams and other problems may occur. Likewise, it is difficult to staple in-bin without a similar such increased vertical separation between bins at the stapling point. Yet, an increased vertical separation between bins at other points is undesirable as it would greatly increase the overall height.

However, this present system appears simpler, cheaper and more compact, and potentially more reliable, than what the known prior art appears to show.

This invention is not related to how staples are fed or inserted and could be used with any preformed staple or unformed wire feeder. Various types of staplers and drives and stapler loaders are known in the art. The following examples, and other art cited therein, are noted by way of background: U.S. Pat. Nos. 2,881,438 to Winkler; 4,552,297 to Belanger et al; 4,151,944 to Picton; 4,632,082 to Kurosawa; 4,344,554 issued Aug. 17, 1982 to T. R. Cross; and a Xerox Disclosure Journal publication of May/June 1987, p. 133–4, by the same William E. Kramer.

An example of a stapler (80) which swings into a stapling position adjacent a copier output is particularly disclosed at Col. 13 and FIG. 8 of U.S. Pat. No. 4,544,185 issued Jan. 14, 1986, to T. J. Hamlin et al. That stapler unit pivots into the bin of a plural bin moving sorter to staple. On-line copier precollated set stapling with a pivotal stapler is disclosed in, e.g., FIG. 5 et al of U.S. Pat. No. 4,313,670 issued Feb. 2, 1982, to J. R. Caldwell. Optional manual set stapling with the same stapler on the copier is shown in Xerox XDJ Publication, Vol. 8, No. 4, July/August, 1983, p. 309–311.

A disclosed feature of the system disclosed herein is to provide, in a sorting apparatus for sorting sheets fed from a fixed position output of a copier which is providing a sequential source of sheets comprising a closely vertically spaced and aligned superposed stacked array of generally horizontal individual sorter bins, with means to vertically move the array of sorter bins relative to the source of sheets for sequentially loading individual sheets into individual sorter bins, and means for horizontally displacing, in coordination with the vertical movement, one said individual sorter bin at a time away from the superposed array out under the fixed position source of sheets, by a substantial portion of the dimension of that bin to expose a substantial portion of said bun relative to said superosed array of other bins to define a merged sheet path therewith, after the bin has been vertically moved into alignment with the fixed position source of sheets, to provide an enlarged bin entry opening into the one displaced bin for a sheet fed from the source of sheets into the one displaced bin without requiring any change in the vertical spacing between the bins, and for subsequently horizontally moving a bin so displaced back into the vertically superposed alignment with the other bins of the array.

Further features provided by the system disclosed herein, individually or in combination, including stapling sheets sorted into the bins of the sorting apparatus, wherein the same means for partially horizontally displacing the sorter bins also functions to move one displaced bin at a time into the stapler for stapling the sheets sorted in that bin and for removal therefrom; an/or wherein the means for partially horizontally displacing the sorter bins comprises individual pins connecting with respective individual sorter bins in a substantially vertically aligned array and an open jaw actuating system through which open jaw the vertically aligned array of pins is movable to vertically move the array of sorter bins, which open jaw actuating system is adapted to engage and horizontally move a selected the pin which is in the open jaw; and/or wherein the means for partially horizontally displacing the sorter bins comprises individual camming pins connecting with respective individual sorter bins in a substantially vertically aligned array, and a cam track system, with a horizontal displacement transition therein, for engaging the pins and causing a partial horizontal displacement thereof as the bins are moved by the means to vertically move the array of sorter bins, and/or wherein the source of sheets mates with the horizontally displaced sorter bin by the displaceed sorter bin moving closely under the outlet of the source of sheets to provide a controlled and downwardly angled sheet guiding path into the displaced sorter bin at an angle to the sorter bin to deflect and resiliently bend the sheet entering the displaced bin thereby resiliently pressing the sheet down into the bin utilizing the beam strength of the sheet.

All references cited in this specification, and their references, are incorporated by reference herein where appropriate for appropriate teaching of additional or alternative details, features, and/or technical background.

Various of the above-mentioned and further features and advantages will be apparent from the specific apparatus and its operation described in the examples below. The present invention will be better understood by reference to this description of these two embodiments thereof, including the drawing figures (approximately to scale) wherein.

Figure 1:
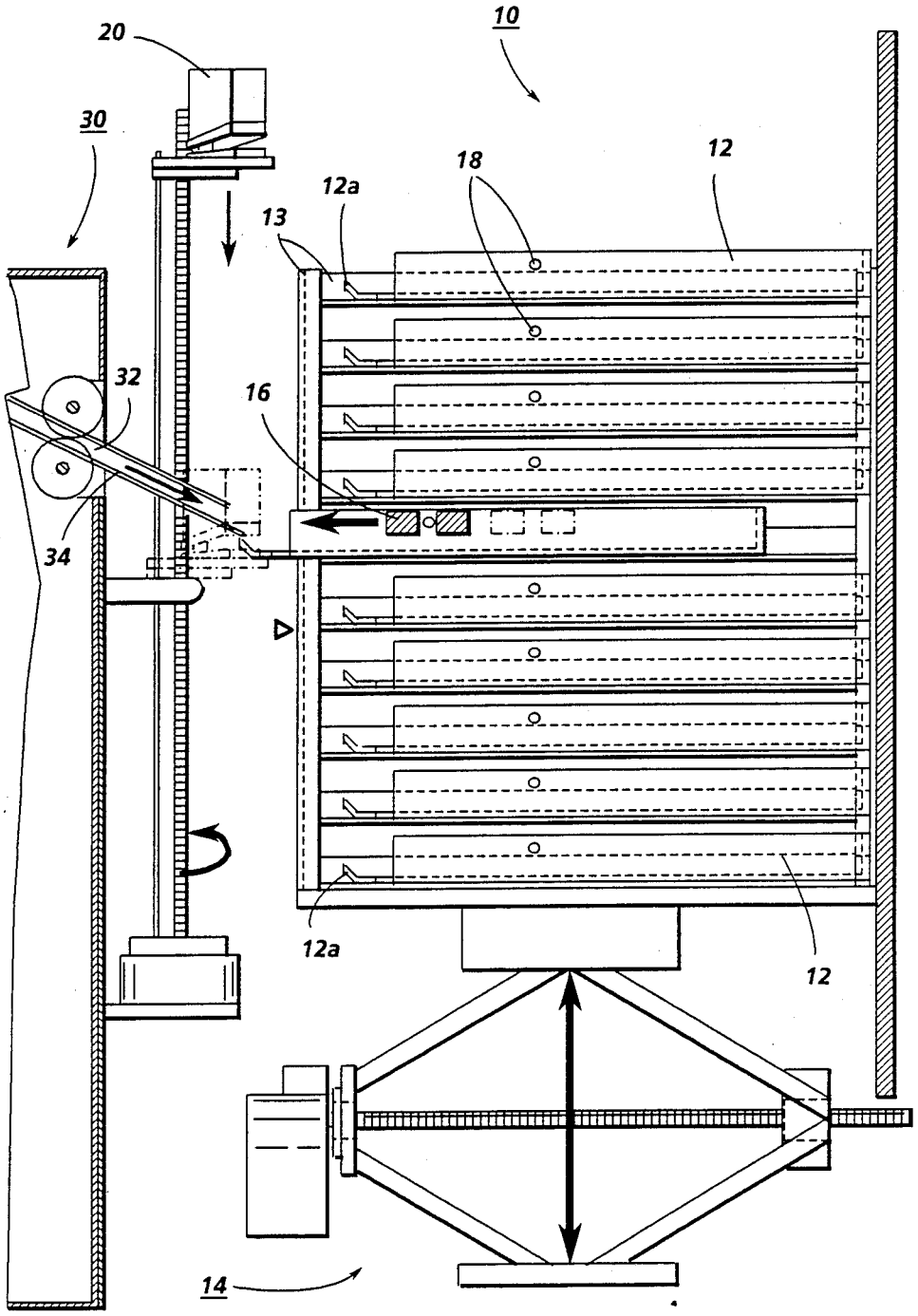
FIG. 1 is a schematic side view of a sorter/stapler embodiment in accordance with the present invention, shown as one bin is being loaded with a sheet.
Figure 3:
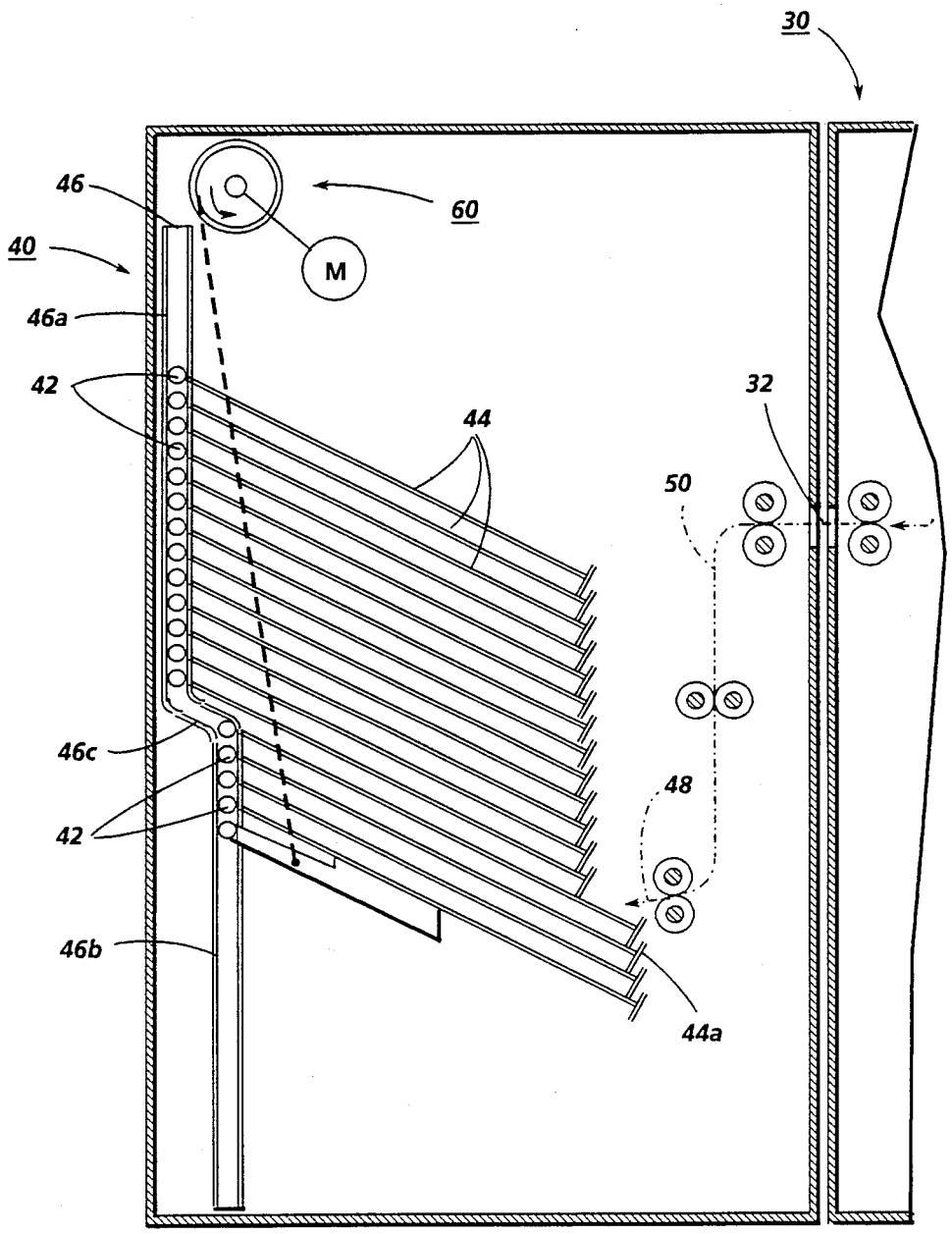
FIG. 3 is a schematic side view of another embodiment of the subject sorter.

The bin heights are somewhat exaggerated in FIGS. 1 and 3 here, and their preferable actual vertical spacing may be even closer. In FIG. 1, the exemplary front support frame members for the bin array are shown removed for drawing clarity.

Figure 2:
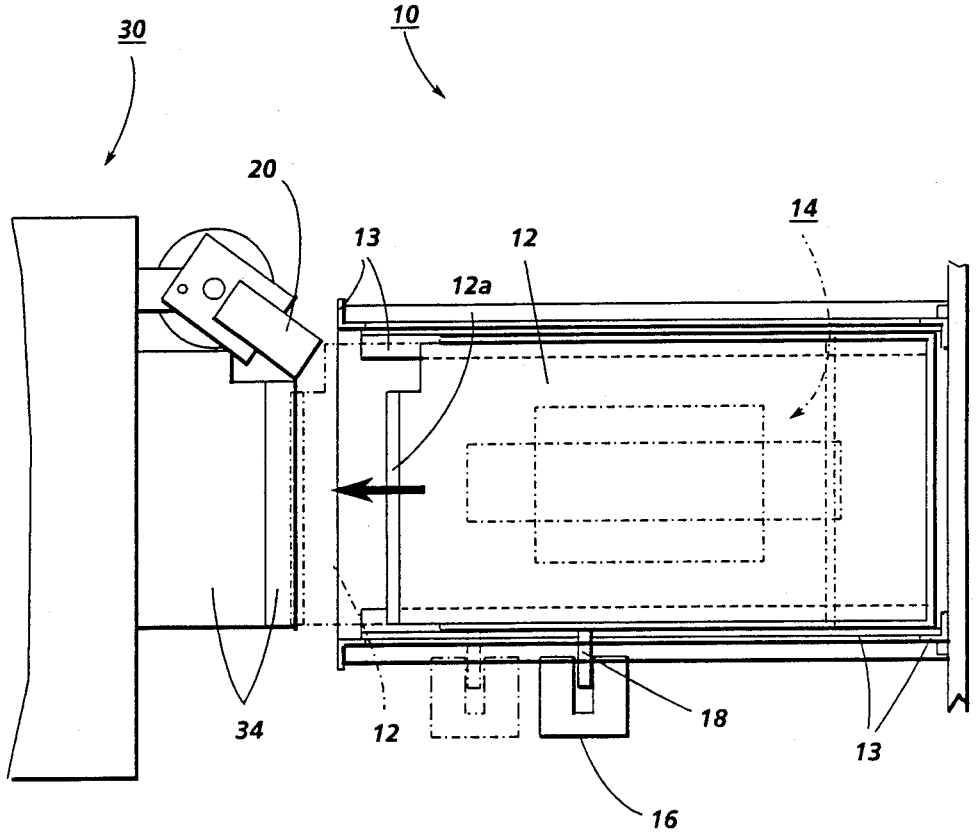
FIG. 2 is a top view thereof, with the extended tray shown here in phantom for drawing clarity.

In the embodiment shown in FIGS. 1 and 2, there is an exemplary ten bin sorter unit 10 with ten trays or bins 12, movable integrally vertically as a set without change in spacing by a vertical transport 14. Each tray 12 may be on a support or carrier 13. As shown here, each tray 12 may be slidably mounted on top of a tray support plate 13, and these supports may be fixed at the desired tray spacing intervals in a simple framework. The entire framework unit may thus be moved vertically as a unit to move the set or array of bins as a unit, like a furniture "chest of drawers". Alternatively, the trays or the supports therefore may be mounted conventionally by projecting pins to a vertical transport such as plural vertical screw shafts, or the like.

Any suitable mechanisms may be used for the desired described movements. The vertical bin set movement system 14 shown here may be a conventional mechanism per se or one of many known systems for raising and lowering a rack or set of sorter bins relative to a copier output exit. A conventional light weight motor driven oppositely screw threaded crossjack, as is used for paper stack elevators in copiers, is shown here in FIGS. 1 and 2. An alternative system of three vertical lead screws engaging tray pins is shown for example in Stemmle U.S. Pat. No. 3,788,640, and other patents.

However, it is important to note that here no bin separating motion or other irregular vertical movement is required. The bins are all moved in a common vertical movement as a vertically unseparated stack of bins, with no differences in their vertical movements. This greatly simplifies the vertical bin set movement system. Yet sheets may be loaded into the bins easily, and even bidirectionally, i.e., during either the up or down travel of the bins past the sheet entrance or loading position. The desired bin loading entrance opening to a bin and its sheet path coupling with the sheet entrance is provided here by a horizontal slide-out bin movement of the bin to be loaded. That horizontal bin movement can also be used for stapling the set after loading, if desired.

In this illustrated embodiment of FIGS. 1 and 2, the dual mode horizontal bin movement is by a reciprocal movement of a selected bin by reciprocal movement of a simple reciprocating open jaw 16. As noted, the illustrated bin array structure is somewhat equivalent to an integral furniture "chest of drawers", except that at least one side of the trays, and preferably several sides, are exposed, and each tray has a pin 18 projecting horizontally therefrom. The simple pin 18 extending from each bin is roughly sequentially aligned with (placed within) the jaw 16 opening by the vertical movement of the set of bins by the vertical bin set movement system 14. The jaw 16 is cross-sectioned in FIG. 1 at its opening for drawing clarity. As shown, this horizontal jaw opening is substantially larger than the pin 18 diameters. The vertical jaw opening dimension is less than the distance between pins, and the distance between pins corresponds to the spacing between trays or bins. Whichever pin 18 is in the jaw 16, i.e., vertically aligned with the jaw 16, is reciprocally moved with the jaw, moving that one bin horizontally, but not any of the other bins, which are outside of the jaw 16. The jaw 16 can be on the end of a crank arm driven by a motor, or reciprocated by a solenoid, or pneumatic piston, or any other conventional or suitable drive. The open jaw 16 in its normal position allows all the pins 18 to freely move vertically either up and down therethrough, since in the normal position of the trays 12 the pins 18 are all vertically aligned with one another and the jaw opening. Note that the pins are perpendicular the horizontal tray movement direction. The jaw 16 moves the one tray aligned therewith out to form a guide path to receive a copy sheet and then retracts that tray back to the normal tray position. The next tray is moved into position vertically and the same its done for it, etc., until all the trays are loaded. Note that the jaw 16 can remain in one vertical position or plane at all times. However, alternatively, it could operate at one vertical level for loading and another for stapling.

After collation the sets may be stapled by a conventional stapler unit 20, here a corner stapler. The same jaw 16 movement moves a tray in the same manner out into the jaws of the stapler 20 for stapling. The tray corner is cut-away to allow this stapling to be done with the set held in the tray in its normal stacking position therein.

Stapling is, of course, done after the collated sets are completed, i.e., after the loading of the trays with all of the sheets being copied from the document or original set. Here, after the sorting operations, each bin set to be stapled is moved in the same manner as it was for loading, with the same mechanism. i.e., one bin partially slides out horizontally in the same vertical location. However this time the stapler unit 20 (here normally positioned above all the bins) has been moved down to a stapling position by a lead screw or other suitable vertical transport and the bin to have stapling done for it partially slides out horizontally from the bin assembly into the stapler for corner stapling. In-bin stapling examples are shown in the above-cited and other art and need not be described in detail here.

Alternatively, the stapler unit could be fixed in one position, and the bins sequentially vertically moved to it, but the present system allows the bin horizontal movement to occur at the same vertical position, thereby using exactly the same horizontal movement mechanism.

Note that the stapler does not have to reciprocate, swing or otherwise move into the tray or bin, or grab the stacks and pull them out of the bins for stapling. That is greatly preferable for simplicity and in view of the required stability, mass and driving power connections of the stapler, as opposed to moving a lightweight bin and one copy stack therein. A conventional rather than a particularly low profile stapler can be used since it is always outside of the normal bin position and does not have to go in between the bins. Also, the stack does not have to be separately supported or rejogged for stapling. No separate sheet compiler is required. Also, there is no undersirable variable angle between the set and the stapler as can occur with a pivoting or rotating bin sorter. True vertical staple-driving-in is insured here.

If desired, simple copy set in-bin jogging or aligning may be provided before stapling. This may even use the horizontal tray motion to provide it in that axis. Various sheet set edge joggers are well know in the art, e.g., lips or end walls in the trays and/or spring pushers, and/or a vertical incline of the trays, and/or a vertical tamper rod extending through all the trays which is horizontally reciprocated against the stack edges, or angled scuffer wheels, or the like.

As noted, no bin pivoting and no "bin opening" system required. That is, no pivoting or other widening of the space between bins to either load or staple is required. Yet the vertical spacing between bins can remain quite small. The bin simply partially slides out horizontally, by a distance which may be less than about 4 centimeters. Yet a wide tray entrance can be provided even for trays closely vertically stacked with as little as 1.25 centimeters vertical spacing. The bin 12 to be loaded simply partially slides out horizontally from a vertically stacked bin assembly for each sheet loading. In the embodiment disclosed herein, the bin to be loaded is vertically aligned with xerographic copier 30 copy output 32. Either the copier 30 itself or the sorter unit 10 can provide an input baffle 34, at the copy output 32. For output copy loading into the sorter the selected bin 12 is horizontally moved towards baffle 34, and effectively mates with it, preferably by closely sliding under it, to provide a sheet escape proof baffling path into the tray. A sheet is preferably fed into that projecting-out portion of the bin at a downwards angle, by the input baffle 34, which is allowed by the horizontal separation of that projecting bin from the other bins. This also allows beam strength sheet deflection for better controlled sheet input feeding. There is close baffle control of both sides of the sheet path due this and the bin positioning relative to the input.

A front wall or lip **12*a* may be provided on each tray, and adapted to be pulled out, in the tray loading position, under and past the baffle or chute 34 from the copier exit 32 so that they overlap and insure that the sheet must enter the tray. These tray lips 12*a* may be angled if desired, as shown, to assist sheet input. Preferably the tray rear lip is vertical. After the sheet is stacked in that bin 12, that bin retracts to its original position and the bin set 10 moves vertically by one bin space and next bin moves out horizontally to be so loaded. That movement is rapid enough to keep up with the copy output rate of the copier 30**.

As noted here, the same apparatus and motion and even motion direction can provide both functions—both the sorting and stapling positioning of the bins. Also, the loading and stapling can be done at the same side of the bins, and the bins therefore do not need to rotate. The trays move vertically in a single unit or holder, simplifying their vertical movement and structure.

The alternative embodiment of FIG. 3 has the same advantages of being a highly compact sorter which creates a bin entrance opening by horizontal tray motion allowing a sheet to enter the tray at a point sufficiently above the tray and existing tray stack surface to prevent sheet stubbing jams. Yet no vertical spreading apart of the trays is required here either. Thus no helical cams or other such mechanisms therefore, or extra vertical space therefore, is required here either. Here a sorter 40 has pins or cam follower rollers 42 connecting to the outside ends of each bin or tray 44, and they are each riding in a generally vertical and fixed cam track 46 with two horizontally spaced or offset vertical track segments **46*a* and 46*b* and a smooth track transition 46*c* therebetween. The bottom of the track transition 46*c* or start (top) of section 46*b* is at a vertical position such that it is engaging a tray 44 pin 42 when the other end of that tray 44 is just under the bin loading sheet entrance 48. (Here, that position is different from the copier exit level, due to angled (approximately 30°) trays 44, and due to an intermediate sorter transport path 50, which could be eliminated.) As the sorter unit or set 40 is lowered by its vertical transport, the cam track 46 in transition 46*c* forces one bin 44 at a time horizontally away from the other superposed bins of the array towards and under bin loading sheet entrance 48. i.e., with its front lip 44*a*** forming an input guide therewith into a large opening into that tray.

In the alternative embodiment of FIG. 3, instead of immediately returning each bin 44 horizontally back to its normal and initial position after loading, all the bins lowered below bin loading sheet entrance 48 are left out in the loading position, in track segment **46*b*, until the completion of one loading cycle, when the entire stack of bins is re-raised above track transition 46*c* into track segment 46*a* by the vertical bin transport, here a lifting cable drive 60, thereby horizontally shifting all the bins back into their normal and initial position. Here the trays or bins 44 are merely stacked on top on one another rather than being mounted on supports in a framework. As shown, projections under the edges of the front lips 44*a*** of the trays, outside of the paper path, but engaging the next underlying tray, may be used in a known manner to maintain the spacing between the trays.

While the embodiment disclosed herein is preferred, it will be appreciated from this teaching that various alternatives, modifications, variations or improvements therein may be made by those skilled in the art, which are intended to be encompassed by the following claims.

We claim:

1. In a sorting apparatus, for sorting sheets fed from a fixed position output providing a sequential source of sheets, comprising a closely vertically spaced and aligned superposed stacked array of generally horizontal individual sorter bins, with means to vertically move said array of sorter bins relative to said source of sheets for sequentially loading individual sheets into individual sorter bins; the improvement comprising: means for individually horizontally displacing, in coordination with said means for vertical bin array movement, with one selected said individual sorter bin vertically moved adjacent said fixed position output source of sheets, said one individual sorter bin at a time away from said superposed array towards said fixed position output source of sheets, by a substantial portion of the dimension of said one bin, to expose a substantial portion of said one displaced bin relative to the next adjacent bin to define a merged sheet path from said fixed position output source of sheets into said one substantially displaced bin by providing a substantially horizontally enlarged bin entry opening into said one substantially displaced bin for a sheet fed from said source of sheets into said one displaced bin without changing said vertical spacing between said bins, and for subsequently horizontally moving a bin so displaced back into said vertically superposed alignment with the other said bins of said array.

2. The sorting apparatus of claim 1 wherein said means for partially horizontally displacing said sorter bins comprises individual cams connecting with respective said individual sorter bins in a substantially vertically aligned array, and a cam track system, with a horizontal displacement transition therein within said vertical spacing between bins and acting on one bin at a time for engaging said cams and causing a substantial partial horizontal displacement of one said bin relative to its next adjacent bin by said displacement transition as said bins are moved by said means to vertically move said array of sorter bins.

3. The sorting apparatus of claim 1 wherein said sorter bins are angled at approximately 30°, and wherein said horizontal tray displacement is used to provide in-bin jogging or aligning.

4. In a sorting apparatus for sorting sheets fed from a sequential source of sheets, comprising a closely vertically spaced and aligned superposed stacked array of generally horizontal individual sorter bins, and means to vertically move said array of sorter bins relative to said source of sheets for sequentially loading individual sheets into individual sorter bins; the improvement comprising means for individually partially horizontally displacing, in coordination with said vertical movement, one said individual sorter bin at a time substantially away from the next adjacent bin towards said source of sheets, to provide a horizontally enlarged bin entry opening into said one displaced bin for a sheet fed from said source of sheets into said one displaced bin without changing said vertical spacing between said bins, and for subsequently horizontally moving a bin so displaced back into said vertically superposed alignment with the other bins of said array; and further including stapling means for stapling sheets sorted into said bins of said sorting apparatus, wherein said same means for individually partially horizontally displacing said sorter bins also functions to move one said displaced bin at a time into said stapling means for stapling the sheets sorted in that bin and for their removal therefrom said stapling means.

5. The sorting apparatus of claim 4, wherein said sorter bins are angled at approximately 30°, and wherein said horizontal tray displacement is used to provide in-bin jogging or aligning before stapling.

6. The sorting apparatus of claim 4 wherein said stapling means staples the sheets so loaded into said bin in the same position of said bin in which said bin was horizontally displaced for the feeding of a sheet therein from said source of sheets.

7. The sorting apparatus of claim 6, wherein said sorter bins are angled at approximately 30°, and wherein said horizontal tray displacement is used to provide in-bin jogging or aligning before stapling.

8. In a sorting apparatus for sorting sheets fed from a fixed position output of a copier which is providing a sequential source of sheets, comprising a closely vertically spaced and aligned superposed stacked array of generally horizontal individual sorter bins, with means to vertically move said array of sorter bins relative to said source of sheets for sequentially loading individual sheets into individual sorter bins, and means for horizontally displacing, in coordination with said means for vertical movement, after said bin has been vertically moved into allignment with said fixed position source of sheets, one said individual sorter bin at a time away from said superposed array to out under said fixed position source of sheets, by a substantial portion of the dimension of said bin, to expose a substantial portion of said displaced bin relative to said superposed array of other bins to define a merged sheet path therewith, to provide a substantially enlarged bin entry opening into said one displaced bin for a sheet fed from said source of sheets into said one displaced bin without changing said vertical spacing between said bins, and for subsequently horizontally moving a bin so displaced back into said vertically superposed alignment with the other bins of said array, wherein said means for partially horizontally displacing said sorter bins comprises individual pins connecting with respective said individual sorter bins in a substantially vertically aligned array and an open jaw actuating system through which open jaw said vertically aligned array of pins is movable by said means to vertically move said array of sorter bins, which open jaw actuating system is adapted to engage and horizontally move a selected said pin which is in said open jaw.

9. In a sorting apparatus for sorting sheets fed from a fixed position output of a copier which is providing a sequential source of sheets, comprising a closely vertically spaced and aligned superposed stacked array of generally horizontal individual sorter bins, with means to vertically move said array of sorter bins relative to said source of sheets for sequentially loading individual sheets into individual sorter bins, and means for horizontally displacing, in coordination with said means for vertical movement, after said bin has been vertically moved into allignment with said fixed position source of sheets, one said individual sorter bin at a time away from said superposed array to out under said fixed position source of sheets, by a substantial portion of the dimension of said bin, to expose a substantial portion of said displaced bin relative to said superposed array of other bins to define a merged sheet path therewith, to provide a substantially enlarged bin entry opening into said one displaced bin for a sheet fed from said source of sheets into said one displaced bin without changing said vertical spacing between said bins, and for subsequently horizontally moving a bin so displaced back into said vertically superposed alignment with the other bins of said array, wherein said source of sheets mates with said horizontally displaced sorter bin by said displaced sorter bin moving closely under the outlet of said source of sheets to provide a controlled and downwardly angled sheet guiding path into said displaced sorter bin at an angle to said sorter bin to deflect and resiliently bend the sheet entering said displaced bin thereby resiliently pressing said sheet down into said bin utilizing the beam strength of said sheet.

10. In a sorting apparatus for sorting sheets fed from a sequential source of sheets comprising a closely vertically spaced and aligned superposed stacked array of generally horizontal individual sorter bins, and means to vertically move said array of sorter bins relative to said source of sheets for sequentially loading individual sheets into individual sorter bins, the improvement comprising means for partially horizontally displacing, in coordination with said vertical movement, one said individual sorter bin at a time from said superposed array towards said source of sheets, to provide an enlarged bin entry opening into said one displaced bin for a sheet fed from said source of sheets into said one displaced bin without changing the vertical spacing between said bins, and for subsequently horizontally moving a bin so displaced back into said vertically superposed alignment with the other bins of said array; further including stapling means for stapling sheets sorted into said bins of said sorting apparatus, and wherein said same means for partially horizontally displacing said sorter bins also functions to move one said displaced bin at a time into said stapling means for stapling the sheets sorted in that bin and for their removal therefrom said stapling means, wherein said means for partially horizontally displacing said sorter bins comprises individual pins connecting with respective said individual sorter bins in a substantially vertically aligned array and an open jaw actuating system through which open jaw said vertically aligned array of pins is movable by said means to vertically move said array of sorter bins, which open jaw actuating system is adapted to engage and horizontally move a selected said pin which is in said open jaw; and wherein said source of sheets mates with said horizontally displaced sorter bin by said displaced sorter bin moving closely under the outlet of said source of sheets to provide a controlled and downwardly angled sheet guiding path into said displaced sorter bin at an angle to said sorter bin to deflect and resiliently bend the sheet entering said displaced bin thereby resiliently pressing said sheet down into said bin utilizing the beam strength of said sheet.

* * * * *